US006733086B1

(12) United States Patent
McSharry et al.

(10) Patent No.: US 6,733,086 B1
(45) Date of Patent: May 11, 2004

(54) VACUUM SYSTEM FOR MILLING MACHINE

(75) Inventors: Chris McSharry, Ooltewah, TN (US); Thomas R. Campbell, Ooltewah, TN (US)

(73) Assignee: RI Properties, Inc., Morris, MN (US)

( * ) Notice: Subject to any disclaimer, the term of this patent is extended or adjusted under 35 U.S.C. 154(b) by 0 days.

(21) Appl. No.: 10/099,197

(22) Filed: Mar. 15, 2002

(51) Int. Cl.[7] ..... E21C 35/29
(52) U.S. Cl. ..... 299/64; 451/456
(58) Field of Search ..... 299/39.2, 64, 1.5; 451/456, 453, 87

(56) References Cited

U.S. PATENT DOCUMENTS

| | | | | |
|---|---|---|---|---|
| 1,207,816 A | | 12/1916 | Thompson | |
| 1,211,902 A | | 1/1917 | Warner | |
| 1,354,076 A | | 9/1920 | Stephens | |
| 1,459,968 A | | 6/1923 | Bailly | |
| 3,608,968 A | | 9/1971 | Burnett | |
| 3,779,606 A | | 12/1973 | Hatcher et al. | |
| 3,929,377 A | * | 12/1975 | Weaver et al. | 299/1.5 |
| 4,037,981 A | | 7/1977 | Wirtgen | |
| 4,139,318 A | | 2/1979 | Jakob et al. | |
| 4,193,159 A | | 3/1980 | Beard, III | |
| 4,193,636 A | | 3/1980 | Jakob | |
| 4,457,043 A | | 7/1984 | Oeberg et al. | |
| 4,561,145 A | | 12/1985 | Latham | |
| 4,723,867 A | | 2/1988 | Wirtgen | |
| 4,827,559 A | * | 5/1989 | Norland | 15/322 |
| 5,037,159 A | * | 8/1991 | Nutter et al. | 299/37.4 |
| 5,063,713 A | | 11/1991 | Buchheit, Jr. | |
| 5,125,128 A | | 6/1992 | Davis | |
| 5,291,697 A | | 3/1994 | Nelson | |
| 5,354,146 A | * | 10/1994 | O'Konek | 299/39.2 |
| 5,468,174 A | | 11/1995 | Bachand et al. | |
| 5,520,288 A | | 5/1996 | Drenter et al. | |
| 5,533,790 A | | 7/1996 | Weiland | |
| 5,622,265 A | | 4/1997 | Drenter et al. | |
| 5,645,232 A | * | 7/1997 | Staples et al. | 241/60 |
| 5,657,876 A | | 8/1997 | Drenter et al. | |
| 5,695,385 A | | 12/1997 | Bachand et al. | |
| 6,296,318 B1 | * | 10/2001 | Simons et al. | 299/39.2 |
| 6,457,779 B1 | * | 10/2002 | Busley et al. | 299/39.2 |

FOREIGN PATENT DOCUMENTS

| | | |
|---|---|---|
| DE | 36 10964 A1 | 10/1987 |
| DE | 39 12 885 A1 | 10/1990 |

* cited by examiner

*Primary Examiner*—David Bagnell
*Assistant Examiner*—Daniel P Stephenson
(74) *Attorney, Agent, or Firm*—Chambliss, Bahner & Stophel, P.C.

(57) ABSTRACT

A vacuum system is mounted on a portable milling machine for extracting material cut by the milling drum of the machine from the surface of a roadway. The milling machine includes a frame, a propulsion system for advancing the machine across a surface to be milled, a milling drum mounted on the frame for rotation about its axis, and a conveyor for conveying material cut by the milling drum away from the drum. The vacuum system includes a vacuum pump having an air inlet and an air outlet and a nozzle mounted behind the milling drum having an opening for receiving material cut from the surface by the drum. The vacuum system also includes a material collector having an inlet, an air outlet and a material outlet. The collector is adapted for collecting material entrained in air by the pump through the collector inlet and for discharging such material through the material outlet onto the conveyor. The vacuum system also includes a first conduit and a second conduit. The first conduit connects the nozzle and the inlet of the material collector, and the second conduit connects the air, outlet of the material collector and the air inlet of the pump.

18 Claims, 5 Drawing Sheets

VACUUM SYSTEM FOR MILLING MACHINE

FIELD OF THE INVENTION

This invention relates generally to milling or cold-planing machines for milling concrete or asphalt pavements. More specifically, the invention relates to a vacuum system for removing the millings or cuttings cut by the milling machine from the roadway.

BACKGROUND AND DESCRIPTION OF THE PRIOR ART

Roadway repair is often accomplished by overlaying the existing pavement (whether of concrete or asphalt composition) with a new layer (often called a leveling course) of concrete, asphalt or other surfacing materials. Without prior surface treatment, however, this method of repair generally results in the application of insufficient quantities of paving material in the rutted, potholed or otherwise damaged areas, because the overlayment will be applied at the same rate per unit of roadway width in damaged areas (which have a greater depth across the width) as in the undamaged areas. The resulting reduced density in the overlayment of the previously damaged areas will lead to renewed rutting or other wear damage in the new pavement in relatively short order. However, by milling or planing the surface of the damaged pavement to a flat surface, the damaged areas will be eliminated and the new pavement will have a uniform density across the entire width of the roadway. In addition, a repaying technique that includes milling a thickness of old pavement and replacing it with an equivalent thickness of new pavement will return the elevation of the roadway to its initial level, whereas the placement of a leveling course atop damaged pavement will tend to raise the surface of the roadway or some portion thereof above its original elevation. This can require the raising of road shoulders, guardrails and manhole covers and the adjustment of overpass clearances, all of which is unnecessary if a proper milling technique is employed. A use of milling prior to repaying can also permit ready establishment of the proper road grade and slope, and thereby avoid drainage and safety problems. Furthermore, milling typically provides a rough surface that readily accepts and bonds with the new asphalt or other pavement overlayment. Finally, milling can provide raw material that can be reclaimed for use in the production of asphalt paving materials.

Milling machines are typically wheeled or track-mounted vehicles that are provided with a rotating drum that includes a plurality of cutting teeth. The drum is mounted on the frame of the machine and adapted to be lowered into contact with the road surface and rotated about a horizontal axis so as to cut into the surface to a desired depth as the machine is advanced along the roadway. Power for rotation of the drum is usually provided by the drive engine for the machine. Such machines are designed to cut into the pavement surface to a depth of eight inches (20.32 cm) or more, and for a width of up to 13 feet (3.96 m).

Generally, the milling machine also includes a conveyor system that is designed to carry the milled material that has been cut from the roadway by the rotating drum to a location in front of, to the rear of or beside the machine for deposit into a truck for removal from the site. This system generally uses the rotation of the milling drum and the proximity of the drum to the inlet of the conveyor to facilitate removal of most of the cuttings. However, such systems will not remove all such cuttings, and all or nearly all of such cuttings must be removed before new asphalt can be laid down. Consequently, a separate sweeper, vacuum truck or similar device is generally employed to remove the cuttings left behind by the milling machine. U.S. Pat. No. 4,139,318 of Jakob et al. describes a milling machine to which a conventional sweeper is attached so that the sweeper follows behind to remove fine dust left behind by the material collection system of the milling machine.

Some attempts have been made to avoid the need for a separate sweeper or vacuum truck in the milling process. Thus, attempts have been made to increase the efficiency of the material collection system of the milling machine by modifying the elements of the conveyor system, changing the arrangement of the conveyor inlet and the milling drum or by modifying the rate of rotation of the drum. Some such modifications and improvements are described in U.S. Pat. No. 4,193,636 of Jakob and U.S. Pat. No. 4,723,867 of Wirtgen. It is also known to incorporate a sweeping apparatus into a milling machine. Thus, for example, U.S. Pat. No. 4,561,145 of Latham describes a material collection system of a milling machine that includes a collection pan with a pair of rotating brushes associated therewith. The brushes are mounted adjacent to and on either side of the mouth of the collection pan and adapted to rotate about vertical axes in opposite directions so as to sweep material into the pan. A vacuum hose connects one side of the collection pan to a ho per in which a vacuum fan is mounted. An exhaust hose connects the opposite side of the collection pan to the opposite side of the hopper, thereby creating a flow of air across the width of the hopper from the exhaust hose to the vacuum hose. A baffle and spray bar in the hopper direct the flow of entrained material from the vacuum hose through a spray of water so that such material falls through the bottom of the hopper and onto a conveyor and is not entrained in the exhaust air passing through the exhaust hose.

All of these previously known systems for collecting material cut from a roadway have various disadvantages. The collection of cuttings by rotation of the cutting drum so as to cast material onto a precisely located input end of the cuttings conveyor is not sufficient to collect substantially all of the cuttings, especially those of finer particle sizes, from the drum. Furthermore, the Latham device with its rotating brushes: located on either side of a collection pan would seem to limit the width of cut that such a collection device could effectively clean. Consequently, subsequent cleaning steps, requiring additional equipment and time, would be required in order to collect substantially all the cuttings from a milling drum of practical width. It would be desirable if a system could be provided that could collect the cuttings from a milling drum, including cuttings of finer particle sizes, as they are cut from the roadway. It would also be desirable to provide such a system that could collect the cuttings of finer particle sizes and direct them to be collected along with the larger sized materials that are cast onto a cuttings conveyor for removal from the roadway site. It would also be desirable to provide such a system that could be mounted on the milling machine itself

ADVANTAGES OF THE INVENTION

Among the advantages of the invention is that it obviates the requirement to employ a separate sweeper or vacuum truck in the milling process. Another advantage of the invention is that it provides a system for collection of cuttings cut by the milling drum but left behind by the conventional removal system of the milling machine and depositing such cuttings onto a conveyor of the milling machine for removal from the roadway site.

Additional objects and advantages of this invention will become apparent from an examination of the drawings and the ensuing description.

EXPLANATION OF TECHNICAL TERM

As used herein, the term "vacuum pump" refers to a device that creates suction or a partial vacuum.

SUMMARY OF THE INVENTION

The invention is a vacuum system for a portable milling machine which includes a milling drum mounted on a frame for rotation about its axis in order to cut material from the surface in the path of the machine. The vacuum system includes a vacuum pump having an air inlet and an air outlet, and a nozzle mounted behind the milling drum. The nozzle has an opening which is adapted to receive material cut from the surface by the drum. The vacuum system also includes a material collector having an inlet, an air outlet and a material outlet. The collector is adapted for collecting material entrained in air by the pump through the collector inlet and for discharging such material through the material outlet onto a conveyor mounted on the milling machine. The vacuum system also includes a first conduit and a second conduit. The first conduit connects the nozzle and the inlet of the material collector, and the second conduit connects the air outlet of the material collector and the air inlet of the pump.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

BRIEF DESCRIPTION OF THE DRAWINGS

The presently preferred embodiments of the invention are illustrated in the accompanying drawings, in which like reference numerals represent like parts throughout, and in which.

DESCRIPTION OF THE PREFERRED EMBODIMENTS OF THE INVENTION

Figure 1:
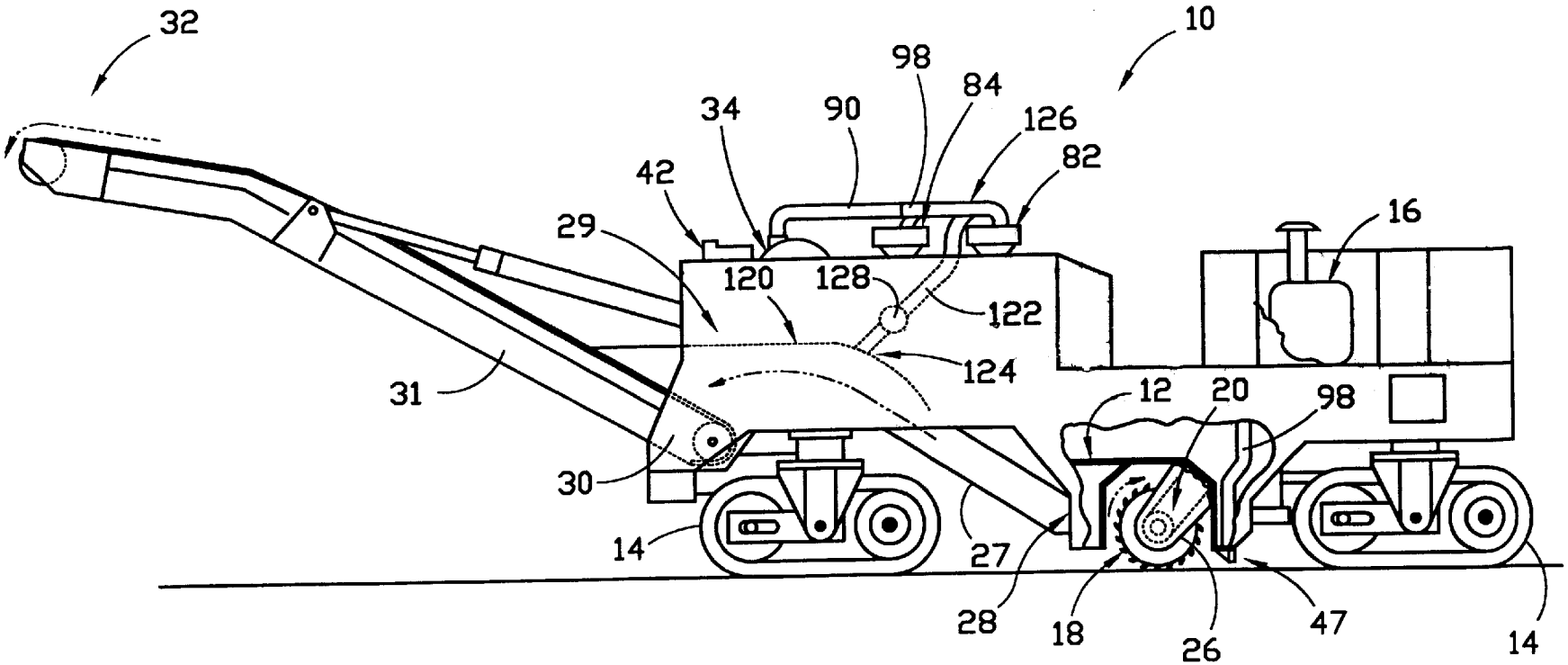
FIG. 1 is a side elevation view, partly in section, of a milling machine which comprises a preferred embodiment of the invention.

Referring now to the drawings, a milling machine embodying the features of a preferred embodiment of the present invention is indicated generally at 10. This machine comprises a portable or mobile vehicle having a frame, a portion of which is shown at 12, and three ground-engaging tracks 14 (two of which are shown in FIG. 1). The invention may also be employed in connection with a track-driven machine having two or four ground-engaging tracks or in connection with a wheel-driven machine. As is conventional, the tracks of the illustrated machine may all be steerable to provide precise directional control, and they are typically driven by hydraulic motors (not shown), which in turn are powered by a propulsion system such as engine 16, to advance the machine across the surface of a roadway, parking lot or other surface to be milled. The machine includes a milling drum 18 which is adapted for cutting a width of material from the surface in the path of the machine. The milling drum is mounted to frame 12 in a conventional way at a medial location of the frame. The drum is mounted for rotation about its axis, a horizontal axis that is generally disposed transverse to the direction of travel "T" of the machine.

Drum 18 is rotatably driven in a clockwise direction (as indicated by the directional arrow) by means of pulley 20 driven by engine 16 or by other convenient means, although it may alternatively be driven in a counterclockwise direction. Machine 10 is designed to convey the milled roadway material in the forward direction for deposit in a truck or other conveyance (not shown). For this purpose, the preferred milling machine includes a two-part conveyor system. This conveyor system includes first (or primary) conveyor 27, which has an input end 28 located adjacent to the drum and an output end 29 that is located above the input end 30 of second (or secondary) conveyor 31. Secondary conveyor 31 also has an elevated output end 32 located in front of the frame of the machine. This arrangement permits rotation of the drum in the indicated direction to lift much of the milled material into the input end of the first conveyor, which conveys the material away from the drum (as shown by the directional arrow) to the secondary conveyor, which in turn conveys the material (as shown by the directional arrow) away from the machine where it may be deposited in a truck.

Figure 2:
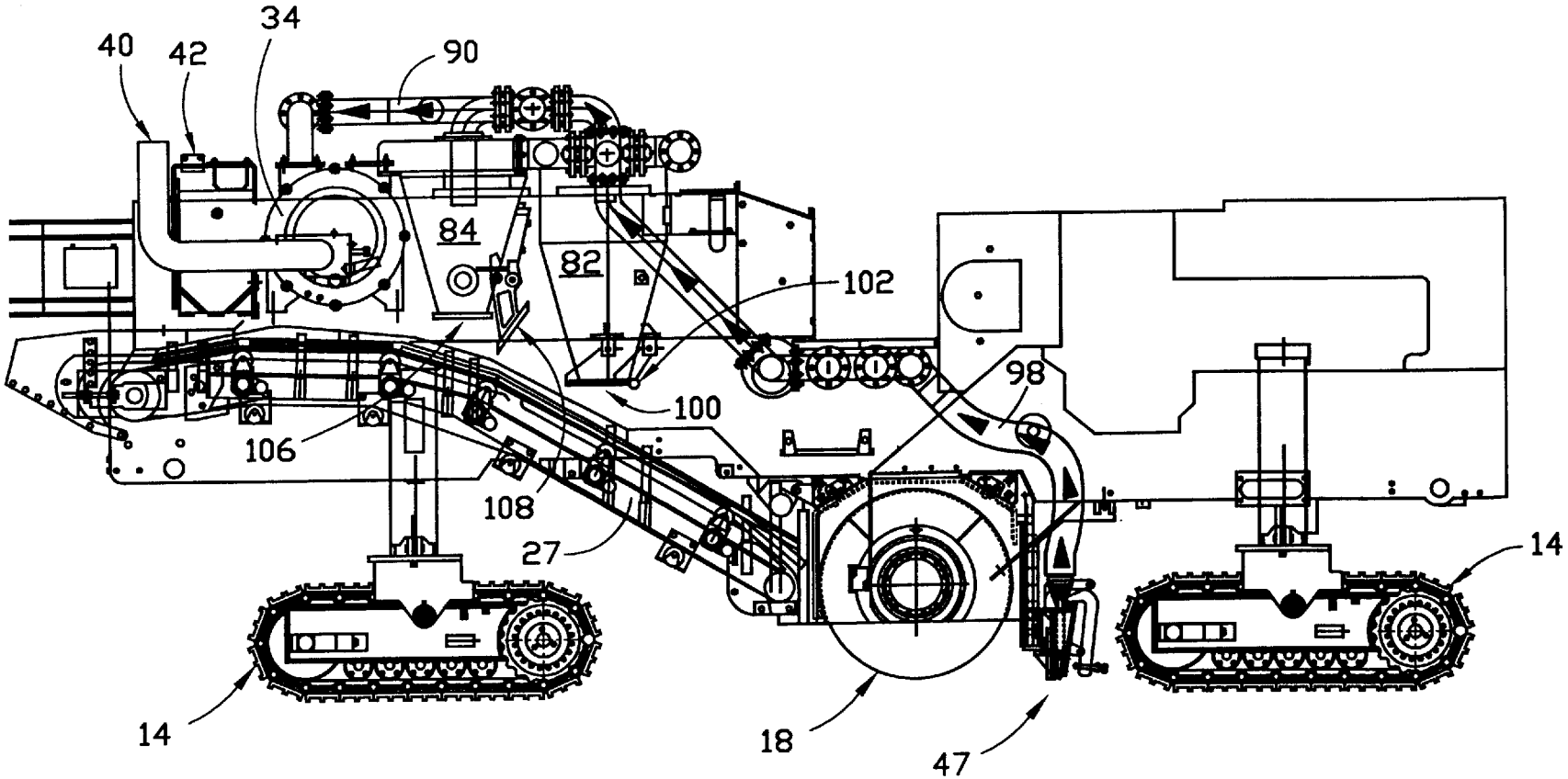
FIG. 2 is a partial sectional view of the milling machine of FIG. 1.
Figure 3:
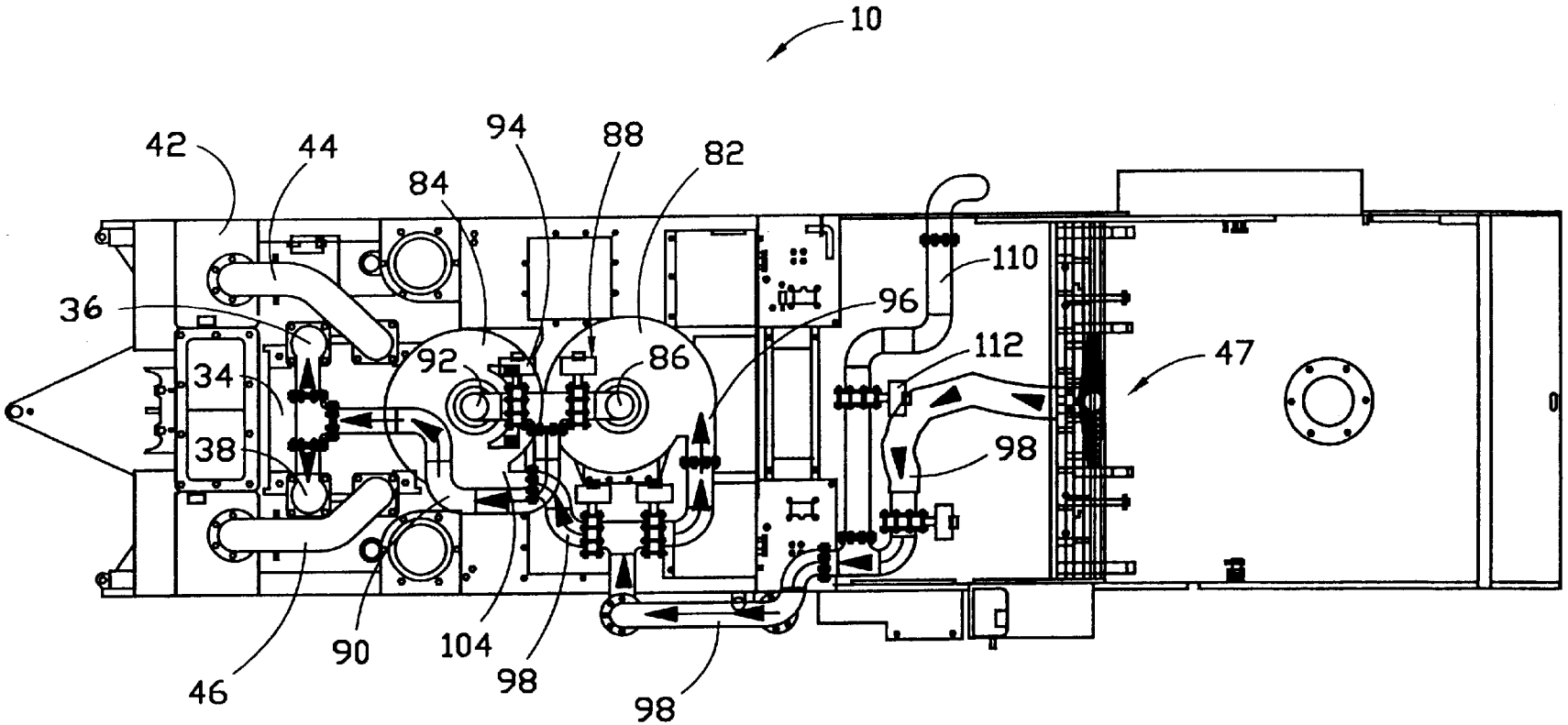
FIG. 3 is a top view of a portion of the milling machine of FIGS. 1 and 2.

The invention includes a vacuum system for extracting material cut by the milling drum from the surface, many of the components of which are best illustrated in FIGS. 2 and 3. As shown therein, machine 10 includes vacuum pump 34 having a pair of air inlets 36 and 38 (FIG. 3) and air outlet 40 (FIG. 2). The vacuum pump is operated to create a partial vacuum therein, and may be of any known type suitable for such purpose. Preferably, the vacuum pump will create a partial vacuum of between about 20 mm and about 40 mm Hg. As illustrated in the drawings, vacuum pump 34 is a centrifugal pump that uses water as a sealing and cooling means, and water for such purpose is stored in tank 42 and transferred between the tank and the pump by water conduits 44 and 46.

Figure 4:
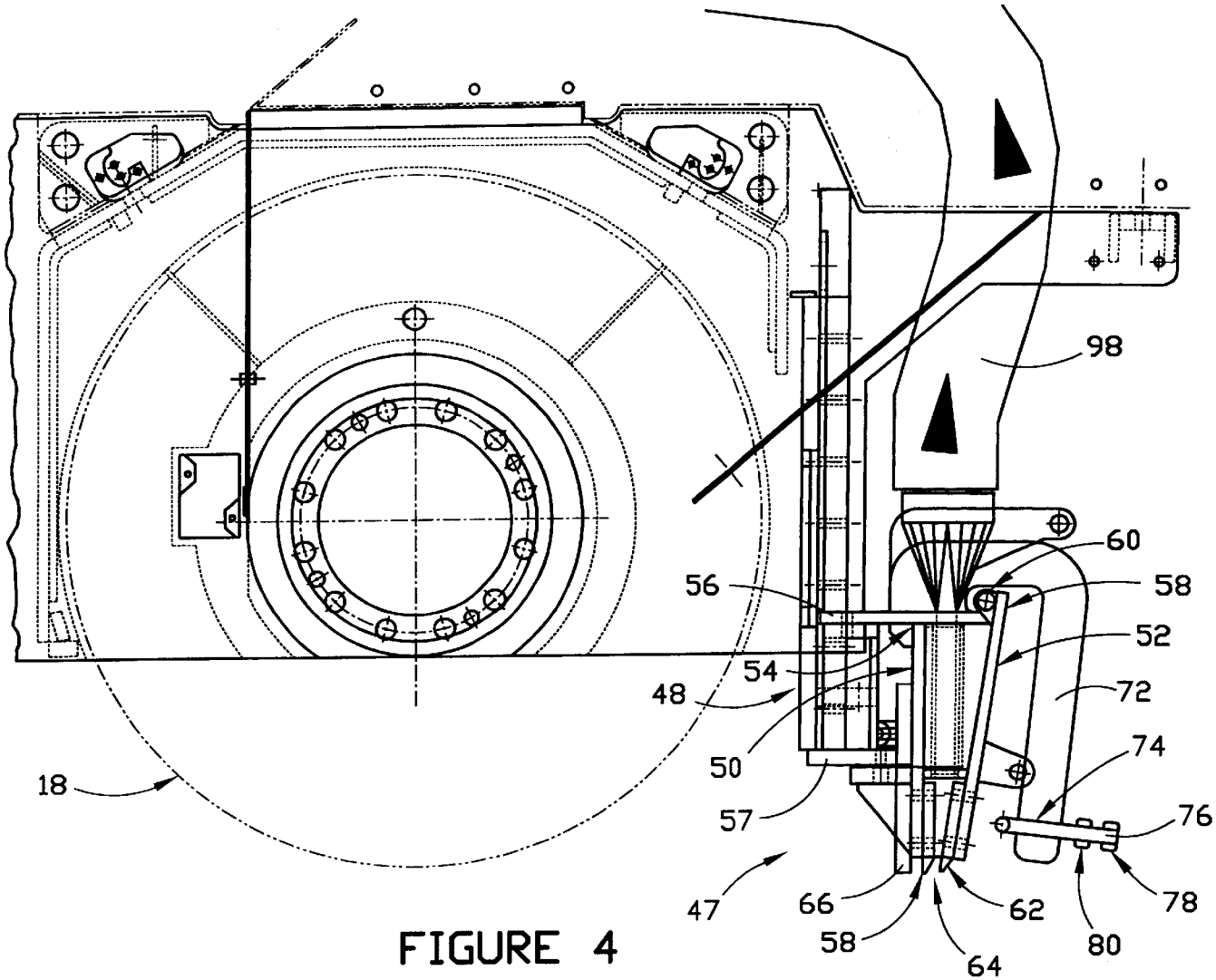
FIG. 4 is an enlarged view of a portion of the milling machine of FIG. 2.
Figure 5:
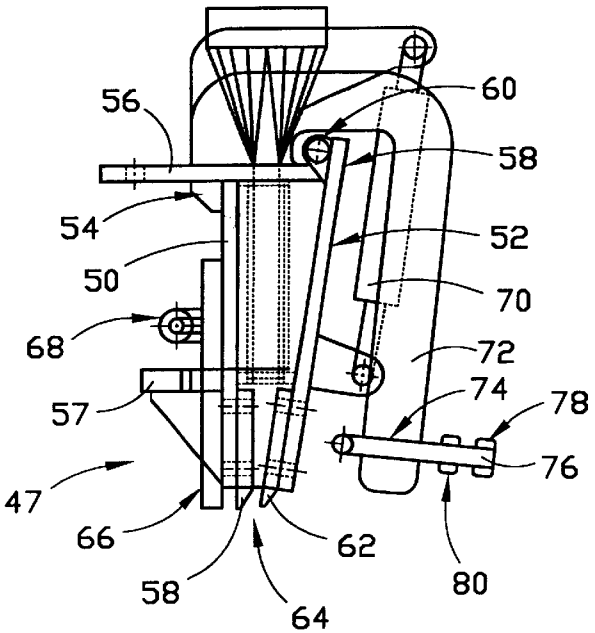
FIG. 5 is an detailed view of the nozzle and associated structures of the preferred embodiment of the milling machine.

The vacuum system also includes nozzle assembly (or nozzle) 47 mounted behind the milling drum. Nozzle 47 has an opening that is adapted to receive material cut from the surface of the roadway by the drum. Preferably, the nozzle opening extends substantially the length of the milling drum and is mounted on moldboard 48 (best shown in FIG. 4) that is located behind milling drum 18. It is also preferred that the nozzle opening is defined by front nozzle plate 50 and rear nozzle plate 52 (best shown in FIGS. 4 and 5). As shown therein, preferred front nozzle plate 50 has an upper side 54 that is welded or otherwise attached to upper moldboard support 56, and a lower side that is welded or otherwise attached to lower moldboard support 57. Upper moldboard support 56 and lower moldboard support 57 are welded or otherwise attached to moldboard 48. The lower side of front nozzle plate 50 is defined by wear plate 56 which is attached by bolts or other suitable means to the lower end of plate 50. As best shown in FIG. 4, the lower side of front nozzle plate 50 is preferably located substantially at the elevation of the surface of the roadway behind the milling drum. Preferred rear nozzle plate 52 also has an upper side 58 that is attached by pivot pin 60 to moldboard support plate 56 so as to provide a pivotal attachment of the upper side of the rear nozzle plate with respect to the moldboard. Preferred rear nozzle plate 52 also has a lower side that is defined by wear plate 62 which is attached by bolts or other suitable means to the lower end of plate 52. Preferably, the lower side of rear nozzle plate is mounted slightly higher than the lower side of the front nozzle plate. Most preferably, the lower side of rear nozzle plate 52 is located about 0.125 inch above the level of the roadway behind the milling drum. As shown in FIGS. 4 and 5, the location of the front and rear nozzle plates forms a gap or nozzle opening 64 between the wear plates on their respective lower sides, which nozzle opening preferably extends substantially the length of the milling drum. Preferably, gap 64 is about 0.375 inch in width.

Figure 6:
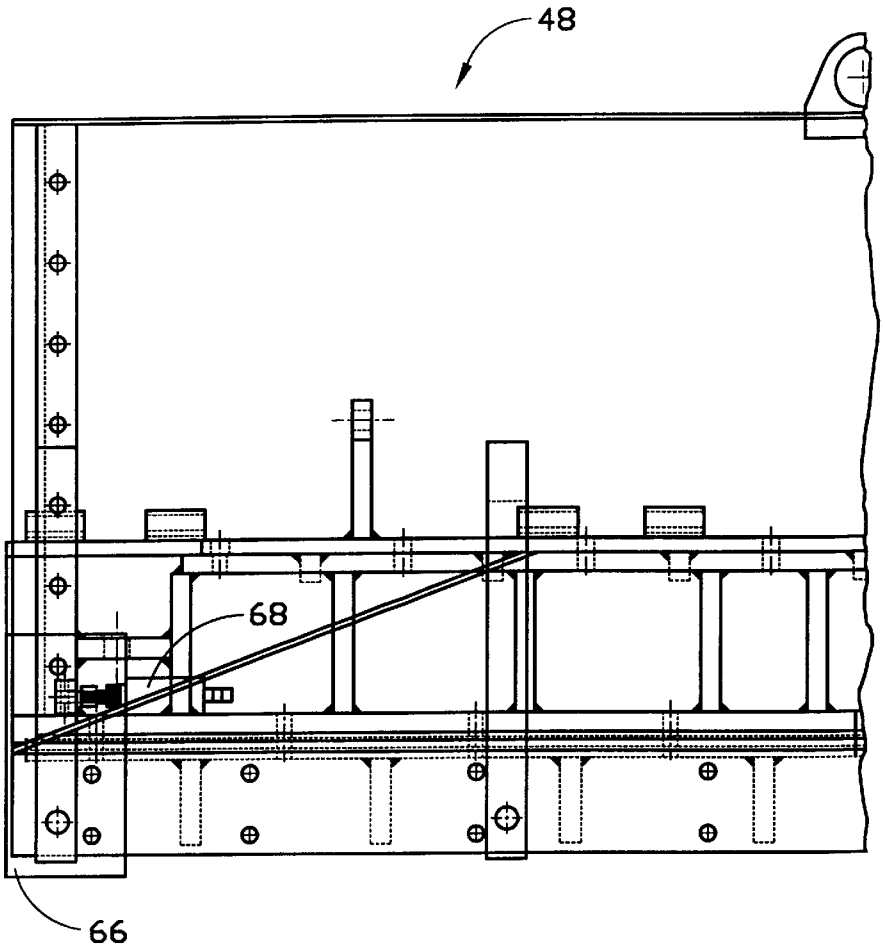
FIG. 6 is a front view of a portion of the moldboard and one of the side sealing plates of the preferred embodiment of the milling machine.

It is also preferred that the vacuum system include a pair of side sealing plates 66 (only one of which is shown in FIGS. 4–6), which are mounted on the moldboard in front of the front nozzle plate and adapted to be laterally adjustable so as to seal between the ends of the moldboard and the sides of the cut made by the milling drum. Preferably, a hydraulic actuator such as actuator 68 (best shown in FIGS. 5 and 6) is mounted between the moldboard and the side sealing plate on each side of the moldboard (only one of which is shown) and adapted to move the side sealing plate laterally with respect to the moldboard to perform the sealing function.

As has been previously mentioned, it is preferred that the upper side of rear nozzle plate 52 is pivotally mounted with respect to the moldboard. It is also preferred that a plurality of hydraulic actuators such as actuator 70 (see FIG. 5) are mounted along the length of the rear nozzle plate so as to move the lower side of the rear nozzle plate away from the lower side of the front nozzle plate. This may be desirable to clear material that may become clogged between the nozzle plates during operation of the vacuum system. The system may also be programmed to automatically move the lower side of the rear nozzle plate away from the lower side of the front nozzle plate at predetermined intervals so as to prevent any clogging of the nozzle opening. Only a small movement of the rear nozzle plate should be required to clear any clogging that may occur.

The preferred vacuum system also includes a stop mechanism that is adapted to limit the distance that the lower side of the rear nozzle plate moves away from the lower side of the front nozzle plate. As shown in FIGS. 4 and 5, the preferred stop mechanism is comprised of a plurality of stop bars such as stop bar 72 that are welded or otherwise secured to moldboard 48 (not shown in FIG. 5) or to upper moldboard support 56. Each stop bar is provided with a threaded hole 74 through which a stop bolt such as bolt 76 is mounted. By adjusting the length of stop bolt 76 extending through hole 74 and securing the bolt to the stop bar at the desired location with nuts 78 and 80, the distance that lower side of rear nozzle plate 52 moves with respect to the lower side of the front nozzle plate can be limited.

The vacuum system includes a material collector having an inlet, an air outlet and a material outlet, which collector is adapted for collecting material entrained in air by the pump through the collector inlet and for discharging such material through the material outlet onto the primary conveyor. Preferably, the material collector comprises a cyclone, and most preferably, a pair of cyclones 82 and 84 (best shown in FIGS. 2 and 3). Preferably, the cyclones are connected to the vacuum system conduits in parallel fashion so that either one can be operated independently of the other. As best shown in FIG. 3, cyclone 82 includes air outlet 86, which is controlled by valve 88 and connected by conduit 90 to the air inlets 36 and 38 of vacuum pump 34. Similarly, cyclone 84 includes air outlet 92, which is controlled by valve 94 and connected by conduit 90 to the air inlets of pump 34. Cyclone 82 also includes inlet 96 which is connected by conduit 98 to nozzle 47, and material outlet 100 (see FIG. 2) which is mounted over the primary conveyor 27 so that material collected in the cyclone may be discharged onto the primary conveyor. Discharge gate 102 (shown in the closed position in FIG. 2) is provided on material outlet 100 to control the discharge of material from cyclone 82 onto the primary conveyor. Similarly, cyclone 84 includes inlet 104 which is connected by conduit 98 to nozzle 47, and material outlet 106 which is mounted over the primary conveyor 27 so that material collected in the cyclone may be discharged onto the primary conveyor. Discharge gate 108 (shown in the open position in FIG. 2) is provided on material outlet 106 to control the discharge of material from cyclone 84 onto the primary conveyor.

As shown by the arrows in FIGS. 2 and 3, operation of vacuum pump 34 creates a partial vacuum that draws air and entrained material through nozzle 47, into conduit 98 and into the inlets of the cyclones. Material is collected therein and discharged through the material outlets of the cyclones onto the primary conveyor. Air from the cyclones is drawn by the action of pump 34 through conduit 90 into air inlets 36 and 38 of the vacuum pump. Air is discharged from the vacuum pump through outlet 40. Valves 88 and 94, mounted on conduit 90 atop cyclones 82 and 84 respectively, may be employed to selectively direct a flow of air (and entrained material) from nozzle 47 through the cyclones to the inlets of the pump. This permits operation of the vacuum system through one of the cyclones when the other is full of material that has been picked up by the nozzle (or when such material is being discharged onto the primary conveyor).

As shown in FIG. 3, preferred milling machine 10 also includes an auxiliary conduit 110, controlled by valve 112 and connected to conduit 98. This auxiliary conduit permits the attachment of a hand-held auxiliary nozzle (not shown) that may be used to clean up material that may be missed by nozzle 47. If valve 112 is open, the operation of pump 34 will draw air (and material that may be entrained therein) through conduits 110 and 98 to the inlets of cyclones 82 and 84.

As illustrated in FIG. 1, preferred milling machine 10 includes first (or primary) conveyor 27 and second (or secondary) conveyor 31, with each of such conveyors having an input end and an output end. A shroud 120 is preferably mounted on the frame so as to partially enclose the output end of the first conveyor and the input end of the second conveyor. Conduit 122, having a first end 124 and a second end 126, is provided to join the shroud to the material collector. Fan 128 is mounted in conduit 122 or otherwise in fluid communication therewith and adapted for propelling air from first end 124 of conduit 122 to second end 126. The fan will thus draw air from outside or underneath the shroud into and through the shroud, entraining any dust obtained by the discharge of material from the output end of the first conveyor onto the input end of the second conveyor, and convey this air and entrained dust through conduit 122 for discharge from second end 126 into the material collector. Preferably, first end 124 of conduit 122 is mounted on the shroud and second end 126 is mounted to conduit 98 for discharge of material collected in the shroud into inlet 96 of cyclone 82 or inlet 104 of cyclone 84.

Although this description contains many specifics, these should not be construed as limiting the scope of the invention but as merely providing illustrations of some of the presently preferred embodiments thereof, as well as the best mode contemplated by the inventors of carrying out the invention. The invention, as described herein, is susceptible to various modifications and adaptations, and the same are intended to be comprehended within the meaning and range of equivalents of the appended claims.

What is claimed is:

1. A portable milling machine comprising:

(a) a frame;

(b) a propulsion system for advancing the machine across a surface to be milled;

(c) a milling drum mounted on the frame for rotation about its axis, which drum is adapted for cutting material from the surface in the path of the machine;

(d) a conveyor for conveying material cut by the milling drum away from the drum;

(e) a vacuum system for extracting material cut by the milling drum from the surface, said vacuum system comprising:

(i) a vacuum pump having an air inlet and an air outlet;

(ii) a nozzle mounted behind the milling drum, said nozzle having an opening which is adapted to receive material cut from the surface by the drum, wherein the nozzle opening is defined by a front nozzle plate and a rear nozzle plate, each of which has an upper side and a lower side and wherein the lower side front nozzle plate is mounted substantially at the elevation of the roadway behind the milling drum;

(iii) a material collector having an inlet, an air outlet and a material outlet, which collector is adapted for collecting material entrained in air by the pump through the collector inlet and for discharging such material through the material outlet onto the conveyor;

(iv) a first conduit connecting the nozzle and the inlet of the material collector;

(v) a second conduit connecting the air outlet of the material collector and the air inlet of the pump.

2. The milling machine of claim 1 wherein the nozzle opening extends substantially the length of the milling drum.

3. The milling machine of claim 1 wherein the material collector comprises a cyclone which includes:

(a) an air outlet;

(b) a conduit which connects the air outlet to the air inlet of the vacuum pump;

(c) a material outlet;

(d) an inlet;

(e) a conduit which connects the inlet to the nozzle;

(f) a valve for selectively directing a flow of air from the nozzle through the cyclone to the inlet of the pump.

4. The milling machine of claim 1 wherein the lower side of the rear nozzle plate is mounted at an elevation higher than that of the lower side of the front nozzle plate.

5. The milling machine of claim 1 which includes:

(a) a moldboard that is mounted behind the milling drum and extends substantially the length of the milling drum;

(b) a front nozzle plate having an upper side and a lower side and which is mounted on the moldboard so as to extend substantially the length of the moldboard with the lower side located substantially at the elevation of the surface of the roadway behind the milling drum;

(c) a rear nozzle plate that is pivotally mounted with respect to the moldboard behind the front nozzle plate so as to form a gap between the lower side of the front nozzle plate and the lower side of the rear nozzle plate;

(d) a pair of side sealing plates which are mounted on the moldboard in front of the front nozzle plate and adapted to be laterally adjustable so as to seal between the ends of the moldboard and the sides of the cut made by the milling drum.

6. The milling machine of claim 5 which includes a hydraulic actuator that is mounted between the moldboard and one of the side sealing plates and adapted to move the side sealing plate laterally with respect to the moldboard.

7. The milling machine of claim 5 wherein the upper side of the rear nozzle plate is pivotally mounted with respect to the moldboard.

8. The milling machine of claim 7 which includes a hydraulic actuator that is adapted to move the lower side of the rear nozzle plate away from the lower side of the front nozzle plate.

9. The milling machine of claim 7 which includes a stop mechanism that is adapted to limit the distance that the lower side of the rear nozzle plate moves away from the lower side of the front nozzle plate.

10. A portable milling machine comprising:

(a) a frame;

(b) a propulsion system for advancing the machine across a surface to be milled;

(c) a milling drum mounted on the frame for rotation about its axis, which drum is adapted for cutting material from the surface in the path of the machine;

(d) a vacuum system for extracting material cut by the milling drum from the surface, said vacuum system comprising:

(i) a vacuum pump having an air inlet and an air outlet;

(ii) a nozzle mounted behind the milling drum, said nozzle having an opening which is adapted to receive material cut from the surface by the drum;

a material collector having an inlet, an air outlet and a material outlets, which collector is adapted for collecting material entrained in air by the pump through the collector inlet and for discharging such material through the material outlet onto the conveyor;

a first conduit connecting the nozzle and the inlet of the material collector;

a second conduit connecting the air outlet of the material collector and the air inlet of the pump;

(e) a first conveyor and a second conveyor, with each of such conveyors having an input end and an output end, said input end of the first conveyor being located adjacent to the milling drum and said output end of the first conveyor being located above the input end of the second conveyor, said first conveyor being adapted for conveying material cut by the milling drum away from the drum to the second conveyor and said second conveyor being adapted for conveying material away from the machine;

(f) a shroud which is mounted on the frame so as to partially enclose the output end of the first conveyor and the input end of the second conveyor;

(g) a third conduit having a first end and a second end, said first end being mounted on the shroud and said second end being mounted to the material collector;

(h) a fan which is mounted in fluid communication with the third conduit and adapted for propelling air from outside the shroud into and through the shroud and through the third conduit for discharge from the second end thereof.

11. A vacuum system for a portable milling machine which includes:

(a) a frame;

(b) a propulsion system for advancing the machine across a surface to be milled;

(c) a milling drum mounted on the frame for rotation about its axis, which drum is adapted for cutting material from the surface in the path of the machine;

(d) a moldboard that is mounted behind the milling drum and extends substantially the length of the milling drum;

(e) a first conveyor and a second conveyor, with each of such conveyors having an input end and an output end, said input end of the first conveyor being located adjacent to the milling drum and said output end of the first conveyor being located above the input end of the second conveyor, said first conveyor being adapted for conveying material cut by the milling drum away from the drum to the second conveyor and said second conveyor being adapted for conveying material away from the machine;

said vacuum system comprising:

(f) a vacuum pump having an air inlet and an air outlet;

(g) a front nozzle plate having an upper side and a lower side and which is mounted on the moldboard so as to extend substantially the length of the moldboard with the lower side located substantially at the elevation of the roadway behind the milling drum;

(h) a rear nozzle plate having an upper side and a lower side and which is pivotally mounted with respect to the moldboard behind the front nozzle plate so as to form a gap between the lower side of the front nozzle plate and the lower side of the rear nozzle plate;

(i) a pair of side sealing plates which are mounted on the moldboard in front of the front nozzle plate and adapted to be laterally adjustable so as to seal between the ends of the moldboard and the sides of the cut made by the milling drum;

(j) a material collector having an inlet, an air outlet and a material outlet, which collector is adapted for collecting material entrained in air by the pump and for discharging such material onto the conveyor;

(k) a first conduit connecting the nozzle and the inlet of the material collector;

(l) a second conduit connecting the air outlet of the material collector and the air inlet of the pump.

12. The vacuum system of claim 11 which includes:

(a) a shroud which is mounted on the frame so as to partially enclose the output end of the first conveyor and the input end of the second conveyor;

(b) a third conduit having a first end and a second end, said first end being mounted on the shroud and said second end being mounted to the material collector;

(c) a fan which is mounted in the third conduit and adapted for propelling air from outside the shroud into and through the shroud and through the third conduit for discharge from the second end thereof.

13. The vacuum system of claim 11 which includes a hydraulic actuator that is mounted between the moldboard and one of the side sealing plates and adapted to move the side sealing plate laterally with respect to the moldboard.

14. The vacuum system of claim 11 wherein the upper side of the rear nozzle plate is pivotally mounted with respect to the moldboard.

15. The vacuum system of claim 11 which includes a hydraulic actuator that is adapted to move the lower side of the rear nozzle plate away from the lower side of the front nozzle plate.

16. The vacuum system of claim 11 which includes a stop mechanism that is adapted to limit the distance that the lower side of the rear nozzle plate moves away from the lower side of the front nozzle plate.

17. The vacuum system of claim 11 wherein the lower side of front nozzle plate is mounted substantially at the elevation of the surface of the roadway behind the milling drum.

18. The vacuum system of claim 17 wherein the lower side of the rear nozzle plate is mounted at an elevation higher than that of the lower side of the front nozzle plate.

* * * * *